US006448711B1

(12) United States Patent
Salavin et al.

(10) Patent No.: US 6,448,711 B1
(45) Date of Patent: Sep. 10, 2002

(54) SIMPLIFIED REGISTRATION IMAGE DISPLAY SCREEN

(75) Inventors: Serge Salavin, Saint Egreve; Jacques Deschamps, Grenoble, both of (FR)

(73) Assignee: Thomson Licensing S.A., Boulogne cedex (FR)

( * ) Notice: Subject to any disclaimer, the term of this patent is extended or adjusted under 35 U.S.C. 154(b) by 0 days.

(21) Appl. No.: 09/445,315

(22) PCT Filed: Jun. 5, 1998

(86) PCT No.: PCT/FR98/01152

§ 371 (c)(1),
(2), (4) Date: Dec. 6, 1999

(87) PCT Pub. No.: WO98/56025

PCT Pub. Date: Dec. 10, 1998

(30) Foreign Application Priority Data

Jun. 6, 1997 (FR) ..... 97 07038

(51) Int. Cl.[7] ..... H01J 17/49

(52) U.S. Cl. ..... 313/582; 313/461; 313/584; 313/631

(58) Field of Search ..... 313/582, 461, 313/584, 585, 631

(56) References Cited

FOREIGN PATENT DOCUMENTS

FR 2417848 6/1981 ..... H01J/17/36
JP 63-179327 7/1988 ..... G02F/1/133
JP 01-079728 3/1989 ..... G02F/1/133

OTHER PUBLICATIONS

Patent Abstracts of Japan, vol. 013, No. 306, Jul. 13, 1989 & JP Pat. No. 01–079728.

Patent Abstracts of Japan, vol. 012, No. 456, Nov. 30, 1988 & JP Pat. No. 63–179327.

*Primary Examiner*—Vip Patel
(74) *Attorney, Agent, or Firm*—Joseph S. Tripoli; Dennis H. Irlbeck; Carlos M. Herrera

(57) ABSTRACT

The invention relates to image display screens using a cell matrix to form an image. More particularly, the invention relates to means for facilitating relative positioning of various elements during manufacturing. The inventive screen consists of at least two electrode networks. One of the characteristics of the invention is that at least one of said networks consists of "variable direction" electrodes which are shaped in such a way that they spread out and then return towards their longitudinal axis to intersect and pass alternatively from one side to the other of said axis. The spread of a variable direction electrode in relation to the longitudinal axis has an amplitude depending on the position of the electrode in respect to a reference position. This arrangement provides appropriate dimensional leeway to facilitate superpositioning of several masks of varying dimensions. The invention is used in "flat screens", specially plasma panels.

15 Claims, 3 Drawing Sheets

SIMPLIFIED REGISTRATION IMAGE DISPLAY SCREEN

FIELD OF THE INVENTION

The present invention relates to image display screens of the << flat screen >> type. It relates more particularly to means used to facilitate and simplify operations for the positioning of the constituent elements of these screens.

BACKGROUND OF THE INVENTION

There are different types of image display screens that come under the category of flat screens, for example plasma panels, liquid crystal displays, screens whose cells use a "point effect" phenomenon to produce an electron beam each or again light-emitting diode screens.

These different flat screens have the common feature of having a matrix structure: to each elementary dot of the displayed image there corresponds a cell (or even several cells in the case of color images) and each cell is defined substantially at the intersection of two or more arrays of electrodes. Consequently, the manufacture of these different types of flat screens entails the same difficult problem for each of them, a problem that lies in the difficulty of registering the different elements used to form a cell, namely the difficulty of positioning all these elements with respect to one another and in the same way for all the cells of the screen.

The following explanations, given with the example of plasma panels (abbreviated as PP hereinafter in the description), will provide for a clearer understanding of the importance of the above-mentioned problem of registration.

PPs work on the principle of an electrical discharge in gases. They generally comprise two insulating plates each bearing one or more arrays of electrodes and mutually demarcating a gas-filled space. The plates are assembled with respect to one another so that the arrays of electrodes are orthogonal. Each intersection of electrodes defines a cell to which there corresponds a gas space.

FIG. 1 shows the structure of an alternating color PP of the type using only two intersecting electrodes to define and control a cell as described especially in the French patent application published under No. 2 417 848.

The PP has two substrates or plates 2, 3. One of them is a front plate 2, namely the one that is on an observer's side (not shown). It has a first array of electrodes called "row electrodes" of which only three electrodes Y1, Y2, Y3 are shown. The second plate 3 forms the rear plate. It is opposite the observer and therefore it is this plate that, preferably, is provided with elements that can prevent the transmission of light to the observer. It has a second array of electrodes called "column electrodes", of which only five electrodes X1 to X5 are shown. The two plates 2, 3 are made of the same material, generally glass. These two plates 2, 3 are designed to be joined to each other so that the arrays of row and column electrodes are orthogonal with respect to each other.

It is common practice that, in the front plate 2, as in the example shown, the row electrodes Y1 to Y3 should be separated from one another by black strips 4 (forming what is called a "black array") designed to improve the contrast between cells of different rows. The row electrodes Y1 to Y3 are covered with a layer 5 of dielectric material by which they are insulated from the gas.

On the rear plate 3, the column electrodes X1 to X5 are also covered with a layer 6 of dielectric material. The dielectric layer 6 is itself covered with layers forming strips 7, 8, 9 of luminophor materials respectively corresponding in the example to the colors green, red and blue. The luminophor strips 7, 8, 9 are positioned in parallel to the column electrodes X1 to X5, above these column electrodes from which they are separated by the dielectric layer 6. The rear plate 3 furthermore has separation barriers 11 that are parallel to the luminophor strips 7, 8, 9 and separate these strips from one another.

The PP is formed by the joining of the front and rear plates 2, 3. This joining sets up a matrix of cells. The cells are then defined each at the intersection between a row electrode Y1 to Y3 and a column electrode X1 to X5 with a pitch P1 parallel to the row electrodes that is given by the distance between the column electrodes and with a pitch P2 along the column electrodes that is given by the distance between the row electrodes. Each cell has a discharge zone whose section corresponds substantially to the facing surface of the two crossed electrodes. In each cell, the discharge into the gas generates electrical charges and in the case of a "alternating" PP, these charges collect at the dielectrics 5, 6 facing the row and column electrodes. In the example shown, this operation is obtained by means of recesses Ep1 to Epn made in the luminophor strips 7, 8, 9 substantially on the useful surfaces of the column electrodes X1 to X5, namely the surfaces of these electrodes that define the section of the discharge zone.

Thus, in the example shown, the intersections made by the first row electrode Y1 with the column electrodes X1 to X5 define a row of cells, each cell being represented by a recess: the first cell C1 is located at the first recess Ep1, the second cell C2 is located at the second recess Ep2 and so on and so forth until the fifth recess Ep5 which represents a fifth cell C5. The first, second and third recesses Ep1, Ep2, Ep3 are respectively located in a green luminophor strip 7, a red strip 8 and a blue strip 9. They thus correspond to monochromatic cells having three different colors which, in a set of three, may constitute a colored cell. Thus, for 1024 colored cells per row for example, the plate 3 must contain 1024 times per line the above-described structure. The column electrodes X1 to X5 have a width Lg1 of about 50 microns and their longitudinal axes are spaced out for example by 250 microns. This gives an idea of the difficulties of manufacture, especially for obtaining an accurate position of the recesses Ep1 to Epn.

The operating quality of the PP depends on the geometrical and dimensional characteristics of the cells, and hence on the quality of registration which is defined as the precision of the positioning, with respect to one another, of its elements such as the row electrodes and the column electrodes, the barriers 11 and the recesses Ep1 to Epn for which, in particular, the required precision of registration may be in the range of ±20 ppm (20 parts per million), i.e. for example 10 $\mu$m.

Such precision is very difficult and hence very costly to obtain in the context of industrial-scale manufacture. Indeed, the manufacture on a plate 2, 3 of the different elements referred to here above makes use in particular of the technique of photographic masks used on photosensitive layers and/or techniques of silk-screen printing. For the rear plate 3 for example, after the array of column electrodes X1 to X5 has been formed and then the dielectric layer 6 has been deposited, the lumionophor strips 7, 8, 9 are deposited on this dielectric layer 6. Then, the recesses Ep1 to Epn are made in the luminophor strips, along with the separation barriers 11, with all the precision possible. The masks used to define the different patterns such as electrodes, recesses, etc. furthermore comprise, in a standard way, specific alignment or positioning patterns used to align elements to be made with those obtained at a previous level or stage of manufacture. It must be noted that the term "mask" is used to designate both photographic masks and silk screens.

FIGS. 2*a,* 2*b* show alignment patterns Ma1, Ma2 of this kind corresponding in the example respectively to a mask 20 for the definition of the recesses Ep1 to Epn or a mask 21 for the definition of the column electrodes X1 to X5. These alignment patterns consist of registration patterns along the two axes X and Y and conventionally they are located outside a useful surface S1, S2 bearing the drawing (not shown) of the elements to be defined.

The alignment pattern Ma1 (FIG. 2*a*) has the general shape of a T formed by a horizontal aperture Oh and a vertical aperture Ov. FIG. 2*b* shows the alignment pattern Ma2: it comprises firstly three vertical reference marks R1, R2, R3 corresponding for example respectively to the column electrodes X1, X2, X3 and secondly a horizontal reference mark Rh. To define the position of the recesses with respect to one of the column electrodes, the electrode X2 for example, it is enough to place the mask 20 bearing the recesses so that the apertures Oh and Ov of the alignment pattern Ma1 are centered respectively on the horizontal reference mark Rh and the vertical reference mark R2.

Naturally, in order that the quality of the positioning of the recesses with respect to the electrodes should be the same for the entire useful surface S1, SZ these two masks 20, 21 should be perfectly matched.

The precision needed for the positioning of the recesses Ep1 to Epn with respect to the column electrode X1 to X5 is of the greatest importance. It may be required to within plus or minus some tens of ppm and of course this precision is required for the mask used to define elements. It is therefore not possible, when such precision is sought to use conventional masks for example of the type made with gelatin on a Mylar support whose cost is not very high, for masks of this type have dimensional variations of more than 10 ppm per 0° C. as well as per percentile point of hygrometry. In addition to this, there is also imprecision due to tracing conditions.

The manufacturers therefore, in making these masks, have been led to use glass-based substrates with very high dimensional stability. However, these substrates have the drawbacks, in particular, of being limited in size and having a very high cost. Their use entails particularly heavy penalties when they are used to obtain insolation by contact for then, despite their high cost, they soon get damaged.

Another difficulty in making such registration arises out of the dimensional variations of the plate 2, 3 when it is subjected to heat treatment. The glass plates 2, 3 undergo a heat treatment effect that comes into play between the making of the electrode arrays and that of the luminophor strips 7, 8, 9 or separation barriers 11. The temperature reached is in the range of 580° C, i.e. the softening point of glass. Upon return to the ambient temperature, the plates 2, 3 show major dimensional variations (in terms of shrinkage and compaction). These variations are difficult to take into account with a view to registration for they are not reproducible to a precision of within more than a few tens of ppm, especially with ordinary sodium-calcium type glass.

These explanations show the seriousness of the problem raised by the registration of the different constituent elements of an alternating PP including the registration made necessary by the assembling of the front and rear plates, in particular when these two plates each bear electrodes as is most usually the case. It must be noted that these problems exist in a manner that is quite similar for the other types of PP and more generally for all the flat image display screens, provided that, like the PP, they comprise a matrix of cells each controlled by means of at least two crossed electrodes.

The present invention is aimed at facilitating the registration of the different elements of the matrix structure display screens. It makes it possible to avoid the various drawbacks mentioned here above, and especially to overcome constraints imposed by differences in dimension between masks and/or between a mask and an already obtained level of elements.

To this end, the invention proposes to provide at least certain electrodes of at least one array with a shape such that it gives a dimensional latitude for example of about hundred ppm or even more and thus makes it possible to compensate for the dimensional differences which are detrimental to the quality of registration.

SUMMARY OF THE INVENTION

According to the invention, there is proposed an image display screen comprising a matrix of cells, at least two electrode arrays, the electrodes of one array being orthogonal to the electrodes of the other array and each cell corresponding to an intersection of electrodes, wherein at least one electrode array comprises so-called variable direction electrodes each positioned along a longitudinal axis and having a shape such that each one diverges from and then approaches its longitudinal axis to intersect it and pass alternately on either side of this axis and plot a repetitive pattern, the divergence shown by a variable direction electrode with respect to the longitudinal axis having an amplitude as a function of the position of the electrode with respect to a reference position, this divergence varying from one electrode to another.

BRIEF DESCRIPTION OF THE DRAWINGS

The invention will be understood more clearly from the following description, made by way of a non-restrictive example with reference to the appended figures, of which.

DETAILED DESCRIPTION

Figure 1:
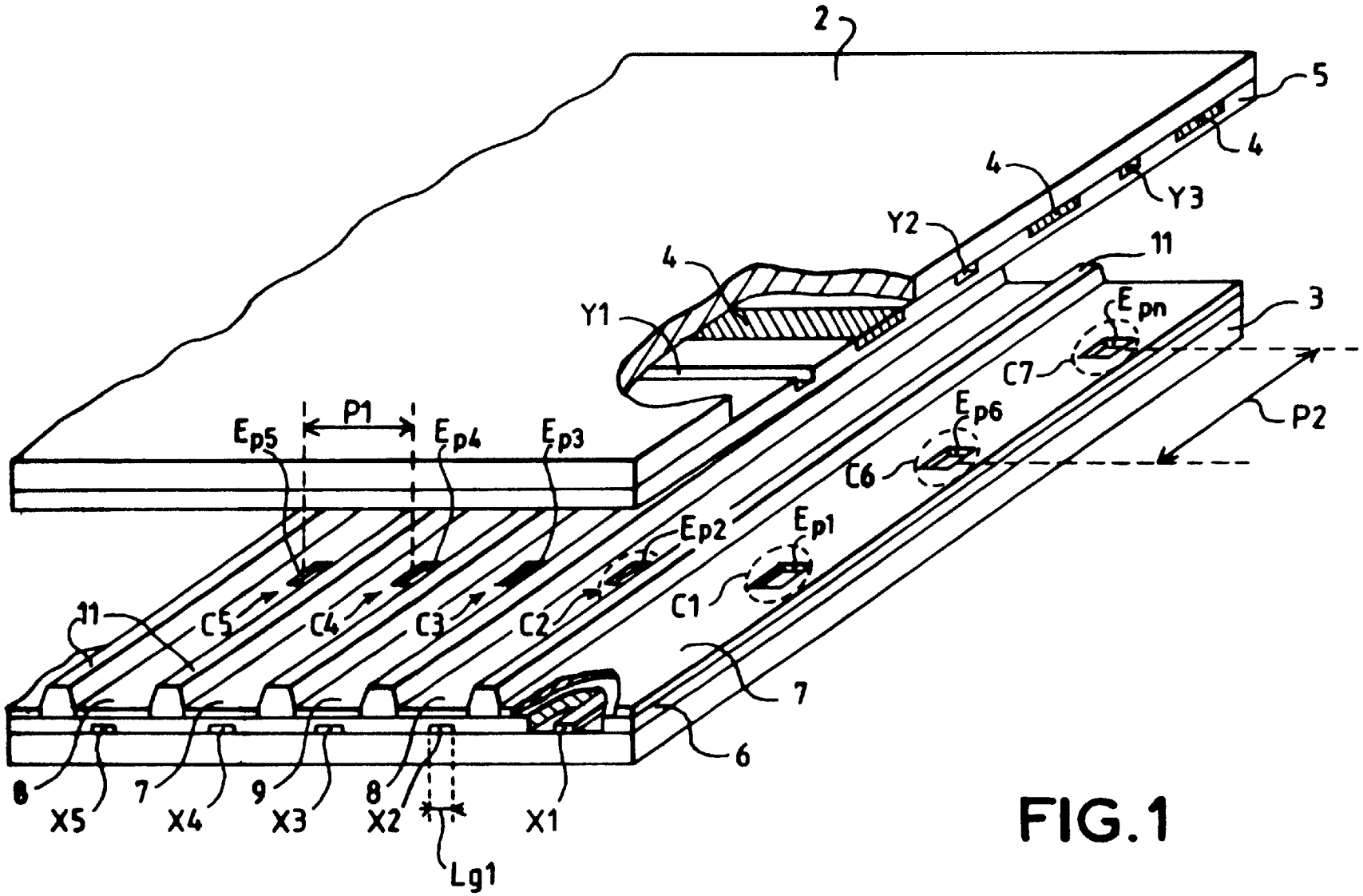
FIG. 1 already described shows a standard structure of a matrix type image display screen.
Figure 3:
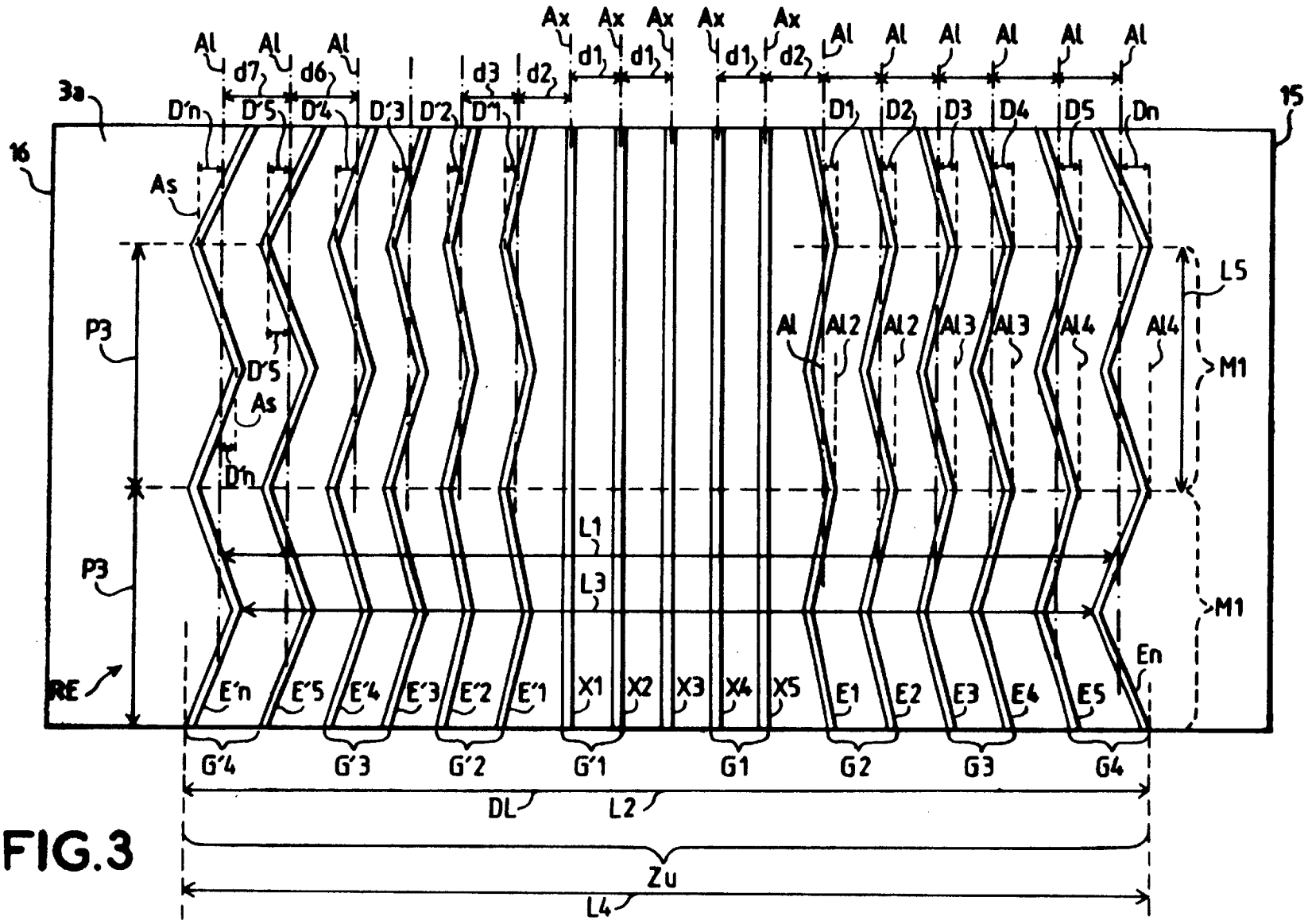

FIG. 3 gives a simplified view of an array of electrodes RE of an image display screen of the matrix structure type according to the invention, for example an alternating PP similar to the one shown in FIG. 1. The array of electrodes according to the invention may be for example an array of column electrodes fulfilling the same function as the electrodes X1 to X5 of FIG. 1 which may also be borne by a support 3*a* such as the rear plate 3 of FIG. 1.

According to one characteristic of the invention, this array of column electrodes comprises so-called variable direction electrodes E1 to En, E'1 to E'n, called variable electrodes hereinafter in the description (in the example shown, the number n of variable electrodes is equal to 6 but of course in practice this number may be is greater, several thousands for example); the other electrodes of this array RE have a conventional shape and are positioned along longitudinal axes Ax and are referenced X1 to X5.

Each variable electrode extends along an axis called a mean longitudinal axis Al. In the non-restrictive example described, its shape is such that it is formed by a sequence of zigzag lines that intersect the mean longitudinal axis Al and pass alternately on either side of this axis. The longitudinal axes Ax are separated from one another by a distance d1 and separated by a distance d2 from the mean longitudinal axes Al, the latter being themselves separated from one another by distances d3 to d7. In a first embodiment of the invention, these distances d1 to d7 are substantially the same.

The to-and-fro motions or excursions of each variable electrode E1 to En, E'1 to E'n with respect to its mean longitudinal axis Al create patterns M1 whose repetition corresponds to a pitch P3 which must be substantially the same as (or a submultiple of) the one according to which the cells (not shown) will be formed along the mean longitudinal axes Al. In other words, if we take for example the PP of FIG. 1, the pitch P3 of these patterns must substantially correspond to the distance between the axes of the row electrodes Y1 to Y3.

The maximum excursion accomplished by each variable electrode E1 to En, E'1 to E'n on either side of its mean longitudinal axis Al is represented in FIG. 3 by the divergence or difference D1 to Dn, D'1 to D'n. This divergence is presented at each pattern MI between the mean longitudinal axis Al and an axis of symmetry As dividing the width of the tracks of each of these electrodes into two. Naturally, the general shape defined here above of the variable electrodes E1 to En, E'1 to E'n may be obtained in different ways, for example by making the electrodes follow a path with a sinusoidal shape.

According to another characteristic of the invention, for each variable electrode E1 to En, E'1 to E'n, the values of divergence D1 to Dn and D'1 to D'n have an amplitude that may vary as a function of the position of the electrode with respect to a reference position.

In the non-restrictive example shown in FIG. 3, the reference position corresponds to a column electrode X3 called a central electrode, that is substantially rectilinear, as well as the four column electrodes X1, X2, X4, X5 in the middle of which it is placed. The central electrode X3 takes up a central position in a useful zone Zu representing the surface area occupied by all the electrodes on a support such as the plate 3*a*. The variable electrodes E1 to En located between the straight electrodes X1 to X5 and an end of the useful zone Zu close to an edge 15 of the plate 3*a* show values of divergence D1 to Dn that can range from an amplitude Amin which is the smallest amplitude for D1 to an amplitude Amax which is the greatest amplitude for the divergence Dn that corresponds to the electrode En at the greatest distance from these straight electrodes.

Symmetrically, there is a similar organization to the left of the straight electrodes X1 to X5 with variable electrodes E'1 to E'n showing values of divergence D'1 to D'n that can range (for example with the same values as in the previous case) from the lowest amplitude Amin to the highest amplitude Amax for the electrode E'n which is the closest to an edge 16 opposite the first edge 15.

The advantage of a configuration of this kind is that, perpendicularly to the variable electrode axes Al, by translation along these axes on the length L5 of a pattern M1, it offers a variable value at a distance DL defined between the two end electrodes En and E'n, this distance DL being capable of forming a row of elements such as recesses with a view to forming cells. The distance DL is made variable within limits given by the maximum amplitude Amax of the values of divergence Dn, D'n. Indeed it can be observed that:

- on a straight line perpendicular to the mean longitudinal axes Al and going through points where the variable electrodes intersect these axes Al, the far edges of the two variable electrodes En, E'n positioned at the opposite ends of a useful zone Zu are separated by a length L1 corresponding to a standard dimension, namely the same as in the case where all the electrodes are straight;
- on another straight line parallel to the length L1 and intersecting the mean longitudinal axes Al at the points where the variable electrodes are at the greatest distance from their longitudinal axes, towards the exterior of the useful zone Zu, the far edges of the two variable electrodes En, E'n positioned at the opposite ends of the useful zone Zu are separated by a second length L2 greater than the first length L1, namely equal to L1+2Dn;
- on another straight line parallel to the length L1 and intersecting the mean longitudinal axes Al at the point where the variable electrodes are at the greatest distance from their longitudinal axis, towards the interior of the useful zone Zu, the far edges of the two variable electrodes En, E'n positioned at the opposite ends of the useful zone Zu are separated by a third length L3 that is smaller than the first length L1, namely equal to L1−2Dn.

A configuration of this kind therefore makes it possible to compensate for a difference in dimension between the plate 3*a* bearing the electrodes such as the one described here above and a mask used to define the additional elements which are made at a subsequent stage. This configuration makes it possible in particular to optimize the superimposition with a mask used to define recesses Ep1 to Epn (shown in FIG. 1) by simple translation along the electrodes. The maximum divergence that can be compensated for, counted for example between the central electrode X3 and one of the end electrodes En, E'n, corresponds to the maximum amplitude Amax of a divergence, this maximum amplitude possibly reaching a hundred or many hundreds of ppm.

Figure 2A:
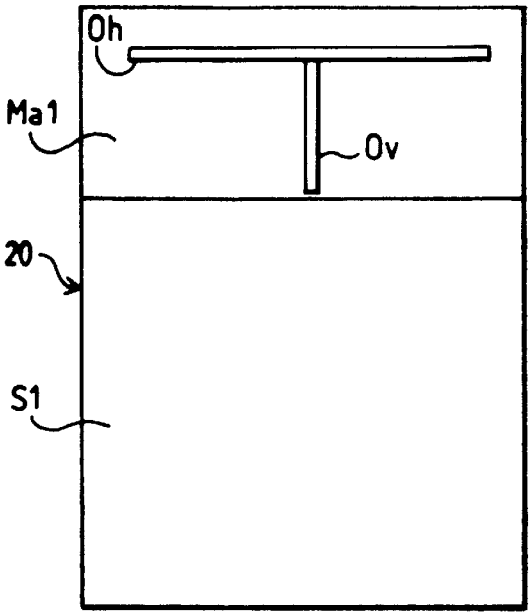
FIGS. 2*a,* 2*b* which are already described show standard registration patterns used for the positioning of the masks, FIG. 3 gives a schematic view of an array of electrodes according to the invention.
Figure 2B:
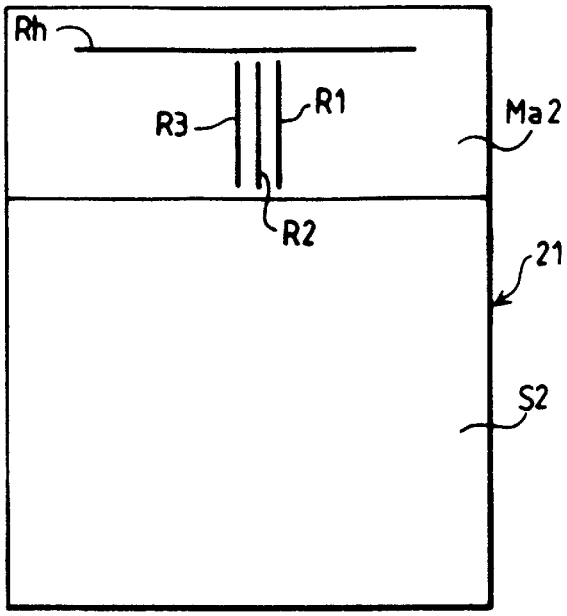
Figure 4A:
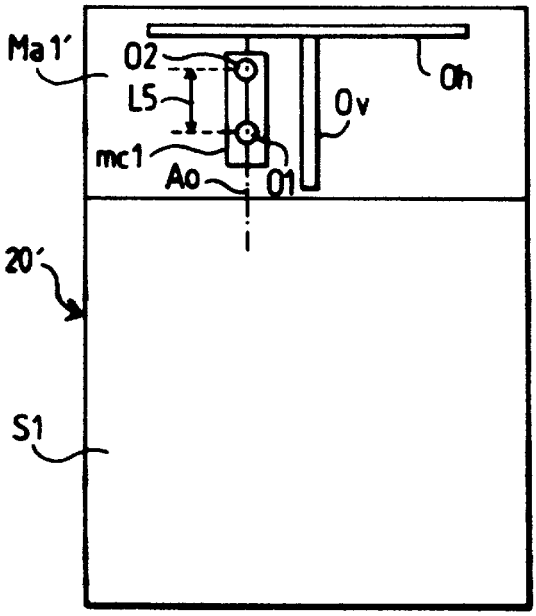
FIGS. 4*a,* 4*b* show patterns of registration of masks compatible with an array of electrodes according to the invention.
Figure 4B:
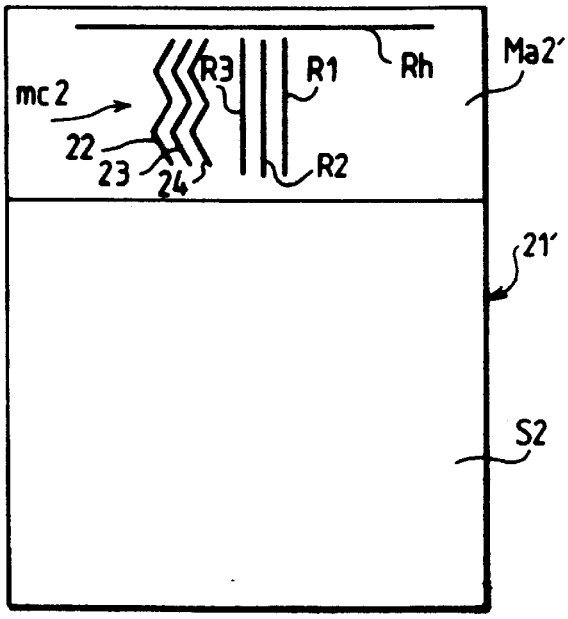

FIGS. 4*a*, 4*b* show patterns of alignment Ma1', Ma2' of masks 20', 21' respectively adapted, on the basis of the alignment patterns Ma1, Ma2 of FIGS. 2*a*, 2*b*, for use with an array RE of electrodes according to the invention.

FIG. 4*b* shows the alignment pattern Ma2': it has three vertical reference marks R1, R2, R3 and the horizontal reference Rh already described with reference to FIG. 2*b* plus an additional alignment element mc2. This element has three drawings 22, 23, 24 side by side each partially reproducing a track of a variable electrode E1 to En. These drawings are positioned in parallel to the reference marks R1, R2, R3.

The alignment pattern Ma1' (FIG. 4*a*) has the horizontal aperture Oh and the vertical aperture Ov (already described with reference to FIG. 2*a*) plus an additional pattern mc1 formed by two apertures O1, O2. These two apertures are positioned on one and the same axis Ao parallel to the vertical aperture Ov and their centers are substantially distant by one and the same length L5 as that of a pattern M1.

Thus, with the alignment pattern Ma2' being transferred to the rear plate 3*a* during the making of the electrodes, it is enough, for the accurate positioning of the masks 20' bearing the recesses, to obtain a coincidence between the alignment patterns Ma1', Ma2' and then translate the mask 20' in parallel to the reference marks R1, R2, R3 up to the time when the two apertures O1, O2 are fully above a track of a drawing 22, 23, 24.

Reference is made again to FIG. 3, in the case for example of an array of column electrodes of PP such as the one shown, the plate 3*a* bearing for example 1024 electrodes, with straight electrodes in the central part such as the electrodes X1 to X5 and on each side variable electrodes E1 to En. The electrode tracks all have one and the same width equal for example to 100 $\mu$m and the distances d1, d2, d3 between axes Ax, Ad of electrodes are the same, for example 0.5 millimeters. Thus, a length L3 of the useful zone Zu is about 520 millimeters and the value of a hundred ppm referred to here above corresponds to about 52 micrometers.

For a divergence Dn having a maximum amplitude conferred on a variable electrode En, E'n at the greatest distance from the electrode which is the positional reference, each intermediate variable electrode E'1 to E'5 may show a divergence D1 to D5 that gradually increases as and when the electrode moves away from the reference position. Assuming for example that the variable electrodes E1 to En located towards the first edge 15 are separated from the variable electrodes E'1 to E'n located towards the second edge 16 by a single straight electrode X3 used as a positional reference, the variation of the amplitude of the divergence between one variable electrode and the next one may be equal to the value of the smallest amplitude Amin. The smallest amplitude Amin corresponds to the amplitude of the biggest divergence Amax, divided by the number N.Ev of variable electrodes, giving Amin=Amax/N.Ev. Thus, in this example, with values of divergence Dn, D'n having the greatest amplitude Amax: the values of divergence D1, D'1 would have the smallest amplitude Amin; the values of divergence D2, D'2 would have the amplitude Amin×2; D3, D'3 would have the amplitude Amin×3, D4, D'4 would have the amplitude Amin×4; D5, D'5 would have the amplitude Amin×5.

However, given limits dictated by the means for the manufacture of masks for electrodes, by tracing means in particular, such gradualness of the amplitude variations of the values of divergence may be difficult to obtain. It is then possible to obtain a variation in the value of the values of divergence D1 to Dn not with each variable electrode E1 to En, E'1 to E'n but by groups of these electrodes. Indeed, rather than modifying, at each variable electrode, the amplitude of the divergence by a low value that is difficult to ensure, it is possible to assign, to N consecutive variable electrodes, one and the same amplitude of divergence and then for the N consecutive electrodes that follow, to increase their amplitude of divergence by a value N that is N times greater.

This possibility is illustrated in FIG. 3 where the different electrodes X1, X2, X3, X4, X5, E1 to En, E'1 to E'n that constitute the array of column electrodes form groups G1, G2, G3, G4, G'1, G'2, G'3, G'4.

The first group Gl positioned to the right of the central electrode X3 is represented by two straight electrodes X4, X5. Then, after G1, there is a second group G2 formed by two variable electrodes E1, E2 showing values of divergence D1, D2 of the same amplitude and then a third group G3 formed by variable electrodes E3, E4 showing values of divergence D3, D4 of the same amplitude and finally a fourth group G4 comprising the variable electrodes E5, En whose values of divergence D5, Dn also have the same amplitude. To the left of the central electrode X3, there is a same organization: namely a group G'1 of two straight electrodes X2, X1 followed by a group G'2 of two variable electrodes E'1, E'2 showing values of divergence D'1, D'2 of the same amplitude, then a group G'3 formed by variable electrodes E'3, E'4 showing values of divergence D'3, D'4 of the same amplitude and finally a last group G'4 comprising the variable electrodes E'5, E'n whose values of divergence D'5, D'n also have one and the same amplitude.

In this configuration where all the variable electrodes belonging to one and the same group have a divergence of the same amplitude, this common amplitude Ac may be determined for each of the groups of electrodes by multiplying the minimum amplitude Amin by the number N.E.P. of electrodes positioned between the group considered and the central electrode X3 and then adding Amin, that is to say by applying the following relationship:

$$Ac=(Amin\times N.E.P)+Amin$$

By applying it to the example of the groups G1, G2, G3, G4 shown in FIG. 3, to the right of the central electrode X3 (however, it is equally valid for the groups located to the left of this central electrode) and if the electrodes E5, En of the group G4 have values of divergence D5, Dn of one and the same amplitude which is the highest amplitude Amax: the two electrodes E1, E2 of the second group G2 have values of divergence D1 and D2 of one and the same amplitude equal to (Amin×2)+Amin, giving 3 Amin; the two electrodes E3, E4 of the third group G3 have values of divergence D3, D4 whose amplitude is equal to (Amin×4)=Amin, giving 5 Amin.

Naturally, in practice, each group may contain a greater number of electrodes than in the example shown so that the increase in the amplitude of the values of divergence from one group to the next group is sufficiently significant to be obtained by the tracing means. For example, if the variation in amplitude of the divergence from one variable electrode to the next variable electrode should be 0.635 micrometers (giving Amin=0.635 $\mu$m), it is easier to give a same amplitude of divergence to ten consecutive electrodes and then increase this amplitude by 6.35 micrometers for the next ten variable electrodes. Thus, in the example of FIG. 3, each group may be formed by N electrodes with one and the same amplitude of divergence in each group, an amplitude which for example would be successively 6.35 $\mu$m, 12.7 $\mu$m, 19.05 $\mu$m, etc. for the successive groups G2, G3, G4, namely with jumps of 6.35 $\mu$m from one group to the other.

The value of the greatest amplitude of divergence Amax is determined so as to enable a compensation for dimensions, especially in order to obtain an accurate superimposition of a mask on electrodes formed on a plate after a plate-electrode assembly has undergone heat treatment (annealing). In such a case, the way in which the dimensions produced by treatment vary is generally known but the value of the variation is difficult to foresee. It is therefore the lack of reproducibility (of plus or minus 50 ppm or even more in the case of a sodium-calcium type glass) that raises particularly great problems.

Thus, when the way in which the variation takes place can be foreseen, it is also possible to adjust the length L4 of the useful zone Zu as a function of the average rate of shrinkage caused by the thermal treatment (annealing). To this end, the invention proposes, in combination with the shape of the variable electrodes E1 to En, E'1 to E'n, to make use of the distances d1 to d7 between axes of electrodes or on some of these distances by increasing them or reducing them in order to increase or reduce the useful zone Zu depending on the way in which the variation is expected to take place. This embodiment therefore consists, for example, in order to increase the length L4 of the useful zone Zu:

either in increasing the distance between the electrodes, namely the distance between the longitudinal axis of one electrode and the longitudinal axis of a following electrode, starting from the central electrode X3 and going up to an end electrode En, E'n by gradual increases: the distance d7 between the electrodes E5 and En is then greater than the distance d6 between the electrodes E4 and E5;

or by acting on these distances by groups G1, G'1, G2, G'2, G3, G'3, G4, G'4 of electrodes. In this case, in taking for example the straight electrodes of the central electrode X3: all the mean longitudinal axes Al of the variable electrodes E1, E2 of the group G2 may undergo a rightward shift by 6.35 μm (these axes are then referenced Al2); the mean longitudinal axes Al of the variable electrodes E3, E4 of the group G3 undergo a rightward shift by 12.7 μm (these axes are then referenced Al3). The mean longitudinal axes Al of the variable electrodes E5, En of the group G4 undergo a rightward shift by 19.05 μm (these axes are then referenced Al4).

It must be noted that, for variations or differences in dimensions that might require compensation in a direction opposite the one token here above as an example, it is sufficient to act in reverse: what must be done then for example is to give the maximum amplitude Amax to the values of divergence D1, D'1 closest to the reference position, namely the central electrode X3 and to give the lowest amplitude Amin to the most distant values of divergence Dn, D'n. Similarly, the modification of the length L4 of a useful zone Zu can be accomplished as a reduction by acting on the distances between electrodes so as to give a greater value to the distance d3 between the electrodes E1 and E2 than to the distance d7 between the electrodes E5 and En.

It must be further noted that the reference position constituted in the above example at a central position by the central electrode X3 may be located at a different position, for example at one of the ends of the useful zone Zu.

The reference position at the central position enables the distribution, on either side of this position, of a difference in dimensions for example between the embodiment of the electrodes on the plate 3*a* and a recess mask to be superimposed on these electrodes. In other words, the maximum amplitude Amax of a divergence Dn may in this case have a value which is half that of the difference in dimensions. On the contrary, should the reference position be located at one end of the useful zone, the maximum amplitude Amax must correspond to the entire value of the difference in dimensions.

The invention can also be applied advantageously to the manufacture of an array of row electrodes such as the electrodes Y1 to Y3 borne by the front plate 2 shown in FIG. 1. In this case, the invention would make it possible, here too, to obtain a latitude in dimensions which in particular would facilitate the positioning of the front plate with respect to the rear plate during the assembly of the two plates. Naturally, if a black contrast-improving array (shown in FIG. 1) is positioned between the row electrodes, the strips 4 of this black array would follow the contour of the electrodes in order to be self-centered like these electrodes.

Thus, as indicated here above, the invention can be applied in a manner similar to that described here above, not only in the other types of plasma panels but also in the other types of image display screens implementing a matrix of cells to form the image.

What is claimed is:

1. An image display screen comprising a matrix of cells, at least two electrode arrays, the electrodes of one array being orthogonal to the electrodes of the other array and each cell corresponding to an intersection of electrodes, wherein at least one electrode array comprises so-called variable direction electrodes each positioned along a longitudinal axis and having a shape such that each one diverges from and then approaches its longitudinal axis to intersect it and pass alternately on either side of this axis and plot a repetitive pattern, the divergence shown by a variable direction electrode with respect to the longitudinal axis having an amplitude varying as a function of the distance between the variable electrode and a reference position.

2. An image display screen according to claim 1, wherein the patterns are repeated according to a pitch corresponding substantially to the pitch that has to be given to cells parallel to the longitudinal axes or corresponding to a sub-multiple of this pitch.

3. An image display screen according to claim 1 wherein, between two variable direction electrodes respectively showing a minimum divergence in amplitude and a maximum divergence in amplitude, the intermediate variable direction electrodes show values of divergence included between the minimum amplitude and the maximum amplitude and varying in a substantially gradual manner from one variable direction electrode to the next.

4. An image display screen according to claim 1 wherein, between two variable direction electrodes respectively showing a minimum divergence in amplitude and a maximum divergence in amplitude, the intermediate variable direction electrodes form groups of electrodes, all the electrodes of one and the same group showing values of divergence of one and the same amplitude.

5. An image display screen according to claim 4, wherein the amplitudes of the values of divergence shown by the electrodes vary in a substantially gradual manner from one group of electrodes to the next.

6. An image display screen according to claim 1, wherein the reference position is a substantially central position in a length of a useful zone substantially corresponding to the surface area occupied by all the electrodes of the array.

7. An image display screen according to claim 1, wherein the reference position is a position located substantially at one end of a length of a useful zone corresponding substantially to the surface area occupied by all the electrodes.

8. An image display screen according to claim 1, wherein the reference position corresponds to a substantially straight electrode.

9. An image display screen according to claim 1, wherein the variable direction electrodes are separated from the reference position by a group of straight electrodes.

10. An image display screen according to claim 1, wherein the electrodes of the array are positioned on axes that are all separated from one another by one and the same distance.

11. An image display screen according to claim 1, wherein the electrodes of the array are positioned on axes separated from one another by distances whose value is a function of the position of the electrodes with respect to the reference position.

12. An image display screen according to claim 4, wherein the electrodes of the array are positioned on axes separated from one another by distances whose value is a function of the group to which the electrode belongs.

13. An image display screen according to claim 1, wherein the image display screen is a plasma panel.

14. An image display screen according to the foregoing claim, wherein the variable direction electrodes are borne by a rear plate of the plasma panel.

15. An image display screen according to claim 1, wherein the mask is used to define recesses in a luminophor material.

* * * * *

UNITED STATES PATENT AND TRADEMARK OFFICE

CERTIFICATE OF CORRECTION

PATENT NO. : 6,448,711 B2 
DATED : September 10, 2002
INVENTOR(S) : Serge Salavin and Jacques Deschamps It is certified that error appears in the above-identified patent and that said Letters Patent is hereby corrected as shown below:

Title page,
Item [54], "SIMPLIFIED REGISTRATION IMAGE DISPLAY SCREEN", should read -- IMAGE DISPLAY SCREEN WITH VARIABLE SHAPED ELECTRODES. --

Signed and Sealed this

Seventeenth Day of December, 2002

JAMES E. ROGAN
*Director of the United States Patent and Trademark Office*